US009593899B2

(12) United States Patent
Coppinger et al.

(10) Patent No.: US 9,593,899 B2
(45) Date of Patent: Mar. 14, 2017

(54) NOISE SUPPRESSOR FOR FIREARM

(71) Applicant: Thunder Beast Arms Corporation, Cheyenne, WY (US)

(72) Inventors: Michael S. Coppinger, Cheyenne, WY (US); Kurtis A. Palu, Fort Collins, CO (US)

(73) Assignee: Thunder Beast Arms Corporation, Cheyenne, WY (US)

( * ) Notice: Subject to any disclaimer, the term of this patent is extended or adjusted under 35 U.S.C. 154(b) by 42 days.

(21) Appl. No.: 14/640,791

(22) Filed: Mar. 6, 2015

(65) Prior Publication Data

US 2016/0109205 A1 Apr. 21, 2016

Related U.S. Application Data

(60) Provisional application No. 61/949,670, filed on Mar. 7, 2014.

(51) Int. Cl.
*F41A 21/30* (2006.01)

(52) U.S. Cl.
CPC ..... *F41A 21/30* (2013.01)

(58) Field of Classification Search
CPC ..... F41A 21/30
See application file for complete search history.

(56) References Cited

U.S. PATENT DOCUMENTS

| | | | |
|---|---|---|---|
| 4,576,083 | A | 3/1986 | Seberger, Jr. |
| 4,907,488 | A | 3/1990 | Seberger |
| 5,433,133 | A | 7/1995 | La France |
| 6,308,609 | B1 | 10/2001 | Davies |
| 6,948,415 | B2 | 9/2005 | Matthews et al. |
| 7,062,874 | B1 | 6/2006 | Smith |
| 7,237,467 | B1 | 7/2007 | Melton |
| 7,308,967 | B1 | 12/2007 | Hoel |
| D582,502 | S | 12/2008 | Brittingham |
| D582,503 | S | 12/2008 | Brittingham |
| D584,786 | S | 1/2009 | Brittingham |
| D584,787 | S | 1/2009 | Brittingham |
| D585,518 | S | 1/2009 | Brittingham |
| D591,382 | S | 4/2009 | Brittingham |
| 7,587,969 | B2 | 9/2009 | Silvers |
| 7,588,122 | B2 | 9/2009 | Brittingham |
| 7,594,464 | B2 | 9/2009 | Dueck |
| 7,600,606 | B2 | 10/2009 | Brittingham |
| 7,610,710 | B2 | 11/2009 | Brittingham |

(Continued)

FOREIGN PATENT DOCUMENTS

| | | | |
|---|---|---|---|
| WO | WO 97/07375 | A2 | 2/1997 |
| WO | WO 2011/035111 | A1 | 3/2011 |

OTHER PUBLICATIONS

U.S. Appl. No. 14/615,826; Notice of Allowance dated Feb. 8, 2016; 18 pages.

(Continued)

*Primary Examiner* — Stephen M Johnson
*Assistant Examiner* — Joshua Semick
(74) *Attorney, Agent, or Firm* — Swanson & Bratschun, L.L.C.

(57) ABSTRACT

Novel noise suppressors to attach to firearms comprising a unitary longitudinal baffle system that comprises two elongated bodies containing baffle sections that are assembled together with an outer tube and two end caps.

11 Claims, 4 Drawing Sheets

(56) References Cited

U.S. PATENT DOCUMENTS

| | | | | |
|---|---|---|---|---|
| 7,610,992 | B2 | 11/2009 | Brittingham | |
| 7,661,349 | B1 | 2/2010 | Brittingham | |
| 7,676,976 | B2 | 3/2010 | Dueck et al. | |
| 7,743,693 | B1 | 6/2010 | Brittingham | |
| 7,789,009 | B1 | 9/2010 | Brittingham | |
| 7,856,914 | B2 | 12/2010 | Shults et al. | |
| 7,874,238 | B2 | 1/2011 | Silvers | |
| 7,891,282 | B1 | 2/2011 | DeGroat | |
| 7,905,171 | B1 | 3/2011 | Brittingham | |
| 7,946,069 | B2 | 5/2011 | Dueck et al. | |
| D639,375 | S | 6/2011 | Oliver | |
| D642,648 | S | 8/2011 | Oliver | |
| D642,649 | S | 8/2011 | Oliver | |
| D642,650 | S | 8/2011 | Oliver | |
| D643,087 | S | 8/2011 | Oliver | |
| 7,987,944 | B1 | 8/2011 | Brittingham et al. | |
| 8,087,338 | B1 | 1/2012 | Hines | |
| 8,091,462 | B2 | 1/2012 | Dueck et al. | |
| 8,096,222 | B2 | 1/2012 | Silvers | |
| 8,100,224 | B1 | 1/2012 | Olson | |
| 8,162,100 | B2 | 4/2012 | Shults et al. | |
| 8,167,084 | B1 | 5/2012 | Moore | |
| 8,196,701 | B1 | 6/2012 | Oliver | |
| 8,201,487 | B2 | 6/2012 | Dueck et al. | |
| 8,209,895 | B2 | 7/2012 | Dueck et al. | |
| 8,272,306 | B1 | 9/2012 | Smith | |
| 8,286,750 | B1 | 10/2012 | Oliver | |
| D677,357 | S | 3/2013 | Dueck et al. | |
| 8,387,299 | B1 | 3/2013 | Brittingham et al. | |
| 8,397,862 | B2 | 3/2013 | Shand | |
| 8,424,441 | B2 | 4/2013 | Brittingham et al. | |
| D682,974 | S | 5/2013 | Honigmann | |
| D682,975 | S | 5/2013 | Honigmann | |
| 8,439,155 | B2 | 5/2013 | Shults et al. | |
| D683,806 | S | 6/2013 | Dueck | |
| 8,453,789 | B1 | 6/2013 | Honigmann et al. | |
| 8,459,405 | B1 | 6/2013 | Dueck | |
| 8,459,406 | B1 | 6/2013 | Dueck | |
| 8,474,361 | B2 | 7/2013 | Brittingham | |
| 8,490,535 | B1 | 7/2013 | Moore et al. | |
| 8,505,431 | B2 | 8/2013 | Hines | |
| 8,505,680 | B2 | 8/2013 | Dueck | |
| 8,516,941 | B1 | 8/2013 | Oliver | |
| 8,528,691 | B1 * | 9/2013 | Carmichael | F41A 21/30 181/223 |
| 8,539,708 | B2 | 9/2013 | Kenney et al. | |
| 8,555,765 | B2 | 10/2013 | Graham et al. | |
| 8,567,556 | B2 | 10/2013 | Dueck et al. | |
| 8,579,075 | B2 | 11/2013 | Brittingham et al. | |
| 8,584,794 | B2 | 11/2013 | Dueck | |
| 8,714,301 | B2 | 5/2014 | Shults | |
| 8,739,922 | B2 | 6/2014 | Wirth et al. | |
| 8,763,510 | B2 | 7/2014 | Dueck et al. | |
| 8,770,084 | B2 | 7/2014 | Young | |
| 8,826,793 | B2 | 9/2014 | Oliver | |
| 8,881,862 | B1 * | 11/2014 | Messer, Jr. | F41A 21/30 181/223 |
| 8,939,057 | B1 | 1/2015 | Edsall | |
| 8,950,310 | B2 * | 2/2015 | Storrs | F01N 3/02 181/223 |
| 8,950,546 | B2 | 2/2015 | Shults et al. | |
| 8,973,481 | B2 | 3/2015 | Dueck et al. | |
| 8,991,551 | B2 | 3/2015 | Latka | |
| 9,194,640 | B2 * | 11/2015 | Wirth | F41A 21/30 |
| 9,291,417 | B2 * | 3/2016 | James | F41A 21/30 |
| 9,316,456 | B1 * | 4/2016 | Oliver | F41A 21/34 |
| 9,366,495 | B1 | 6/2016 | Coppinger et al. | |
| 2012/0103176 | A1 | 5/2012 | Latka | |
| 2012/0272818 | A1 | 11/2012 | Dueck et al. | |
| 2013/0180796 | A1 | 7/2013 | Dueck et al. | |
| 2014/0059913 | A1 | 3/2014 | Diamond et al. | |
| 2014/0262605 | A1 * | 9/2014 | Washburn, III | F41A 21/30 181/223 |
| 2014/0318887 | A1 | 10/2014 | Latka | |

OTHER PUBLICATIONS

U.S. Appl. No. 14/816,321; NonFinal Office Action dated Feb. 22, 2016; 17 pages.

U.S. Appl. No. 14/816,321; Final Office Action dated Jul. 11, 2016; 14 pages.

U.S. Appl. No. 14/816,321; NonFinal Office Action dated Oct. 31, 2016; 15 pages.

* cited by examiner

NOISE SUPPRESSOR FOR FIREARM

CROSS REFERENCE TO RELATED APPLICATIONS

This application claims priority to U.S. Patent Application Ser. No. 61/949,670, (the "'670 Application") filed Mar. 7, 2014 by Michael Shane Coppinger et al., entitled, "Sound Suppressor with Longitudinal Baffle," the entire disclosure of which is incorporated herein by reference in its entirety for all purposes.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a firearm noise suppressor containing a unitary longitudinal baffle system as part of a sound suppressor system to be used for a firearm such as a rifle or handgun. The disclosed baffle system comprises two elongated bodies containing baffle sections that can be assembled together with an outer shell and two end caps to form the unitary longitudinal baffle system. The baffle design of the system ensures strong performance, while the system's minimal parts ensure that the system can be easily dissembled for cleaning and correctly reassembled.

BACKGROUND

In order to fire a projectile, a firearm utilizes an ignited propellant to create a high-pressure pulse of hot gases behind the projectile to force the projectile down the barrel of the firearm. When the high-pressure gases exit the barrel of the firearm, they generate a loud noise, commonly referred to as a "muzzle blast." Noise suppressors are commonly used with firearms, such as rifles and handguns, to reduce muzzle blast. To reduce muzzle blast, suppressors attach to the end of the firearm barrel and allow the high-pressure gases to expand, and thereby dissipate pressure, before exiting the firearm. By allowing the pressure behind the projectile to dissipate before exiting the firearm, a firearm suppressor can significantly reduce muzzle blast.

In order to allow the high-pressure gases to expand before exiting the firearm, a noise suppressor creates a significantly larger volume than exists in the firearm barrel. Noise suppressors can create this larger volume through a series of chambers, which are often referred to as "baffles." The size and number of baffles needed to effectively dissipate the high-pressure gases behind the projectile vary depending on a number of factors including without limitation the caliber and barrel length of the firearm as well as the type of ammunition used. To effectively suppress muzzle blast in certain firearms, noise suppressors often utilize a significant number of baffles to create the volume necessary to allow the high-pressure gases to sufficiently dissipate before exiting the firearm.

In suppressors containing baffles, baffles are often manufactured as individual components that are typically connected together through welds or press (interference) fits or held together with threaded interfaces or simply by compression created by holding the baffles together with outer tube and end caps. After the suppressor is used with a firearm, carbon and other byproducts of the expended ammunition can accumulate on both the outside and the inside of the baffles. In welded and press fit baffle systems, the inside of the baffles can be difficult to clean due to limited access to the interior baffles. In baffle systems where the baffles are either threaded together or held together by compression within the outer tube and end caps, the baffles can be easily separated and cleaned, however, these systems have numerous components that can be incorrectly installed during reassembly. If the baffles are incorrectly installed during reassembly, the baffles can be damaged during subsequent use of the firearm. Similarly, in baffle systems relying on compression to hold the baffles together, the baffles can rattle against one another, which can cause the suppressor to make the firearm less accurate.

Suppressors can also be manufactured using a single core within an outer tube and end caps. Such suppressors are often referred to as monocore suppressors. Monocore suppressors, however, are often not as effective at reducing noise as suppressors containing baffles. As a result, suppressors with baffles are often more desirable than monocore suppressors for performance reasons despite the limitations of such baffle-based suppressors described above.

Accordingly, there is a need for a suppressor with a baffle-based noise suppression system that can be easily disassembled and cleaned with minimal components that can be accurately reassembled after cleaning.

BRIEF SUMMARY

Certain embodiments include firearm suppressors comprising two elongated bodies containing baffle sections that can be assembled together with an outer shell, which in certain embodiments is an outer tube, and two end caps to form a unitary longitudinal baffle system as well as tools and techniques to create the same. In an aspect of particular embodiments, a noise suppressor comprises two elongated bodies wherein each body comprises a proximal end, a distal end, and one or more baffle sections aligned along a longitudinal axis running longitudinal from the proximal end to the distal end. When conjoined, the baffle sections form a complete baffle and a bore along the longitudinal axis that the projectile travels through after being fired from the firearm. In certain embodiments, each baffle section within the elongated body has a narrower proximal end and a wider distal end and a sidewall between the proximal end and distal end. Certain of the baffle sections contain apertures to allow gases created from the firing of a projectile to escape into the space between the exterior of the unitary longitudinal baffle system and the interior of the outer tube. In certain embodiments, the elongated bodies are conjoined utilizing alignment tabs. In certain embodiments, the components of the suppressor are made from a material compromising aluminum. Due to the small internal areas and intricate shapes of the two elongated bodies, the elongated bodies can be manufactured using processes comprising Direct Metal Laser Sintering (DMLS) and casting.

The embodiments of the invention described herein are defined by the claims. Further advantages and a more complete understanding of the embodiments will be apparent to persons skilled in the art from review of the following detailed description of various embodiments and appended claims.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

DETAILED DESCRIPTION OF CERTAIN EMBODIMENTS

While various aspects and features of certain embodiments have been summarized above, the following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the described inventions may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Figure 1:
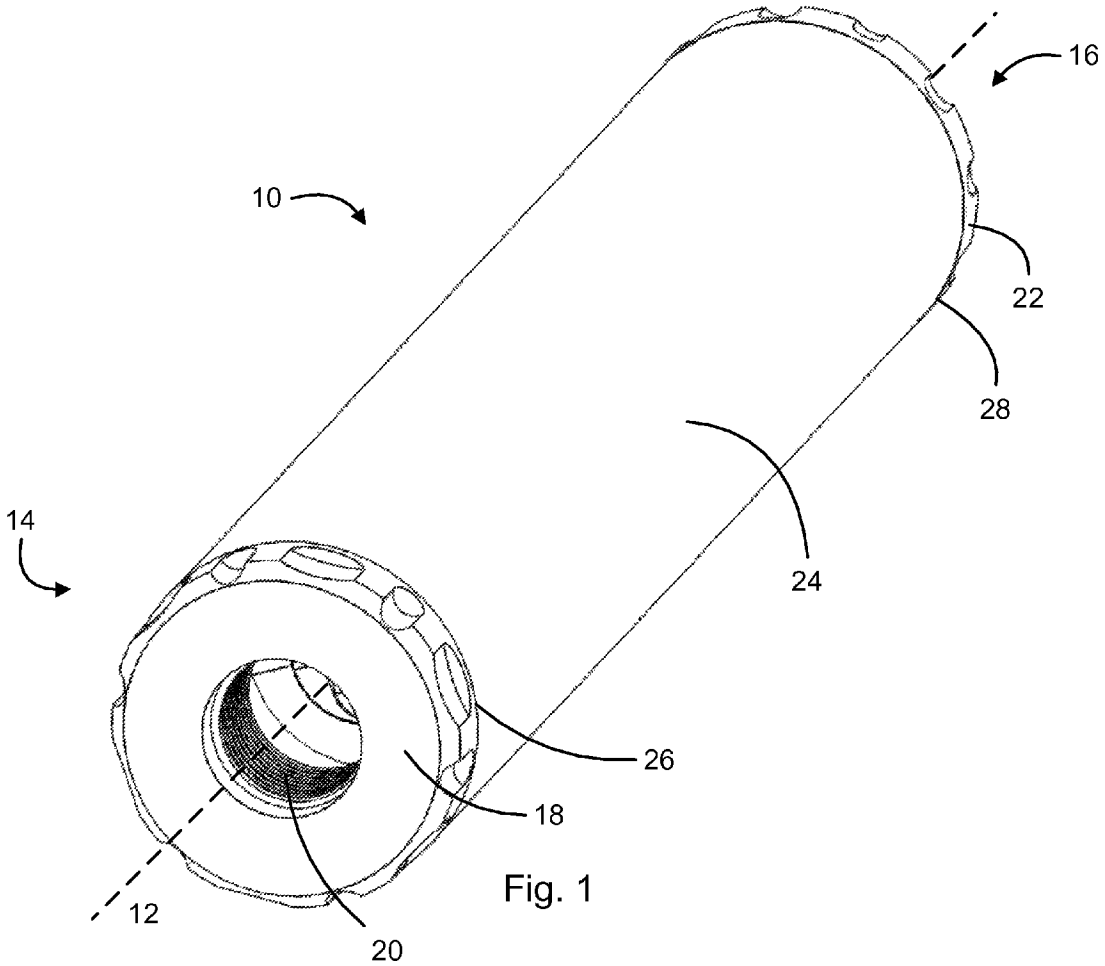
FIG. 1 shows a perspective view of an embodiment of the present invention.

FIG. 1 is a perspective view of an exemplary noise suppressor 10 in accordance with an embodiment of the present invention. As shown, suppressor 10 includes longitudinal axis 12, a proximal end 14, and a distal end 16. As used in this detailed description, the term "proximal" is used to refer to the end of the component or element closest to the barrel of the firearm and the term "distal" is used to refer to the end of the component or element farthest from the barrel of the firearm. Suppressor 10 includes a proximal end cap 18 that attaches to the barrel of the firearm. In other embodiments, the proximal end cap 18 can be modified to connect to a muzzle brake, flash suppressor, or other device that attaches to the barrel of a firearm. In this embodiment, the proximal end cap 18 attaches to the firearm barrel using a threaded interface 20. Suppressor 10 also includes a distal end cap 22 and an outer tube 24. In this embodiment, outer tube 24 abuts to proximal end cap 18 and distal end cap 22 at interfaces 26 and 28, respectively.

Figure 2:
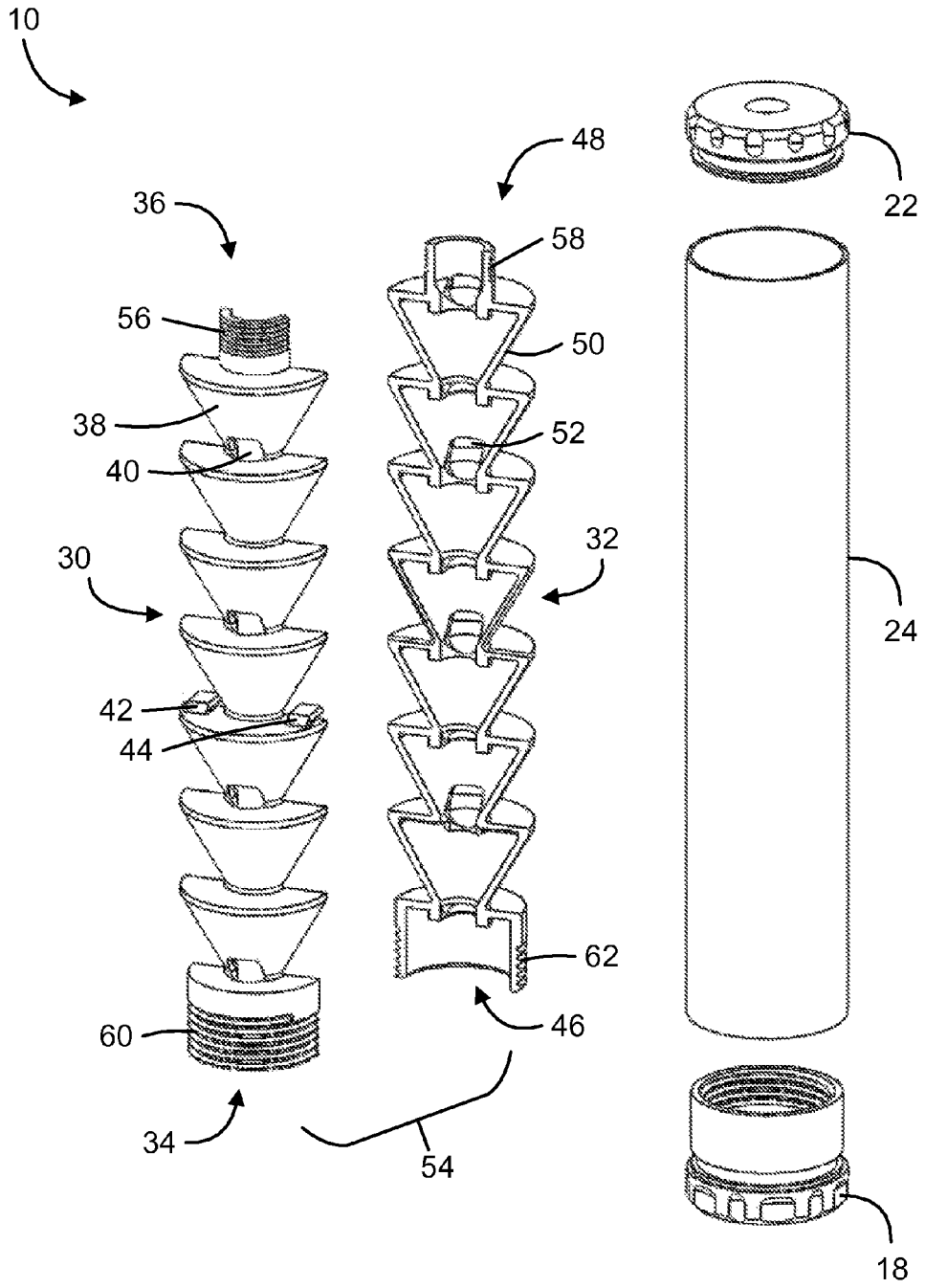
FIG. 2 shows an exploded side view of the noise suppressor of FIG. 1.
Figure 3:
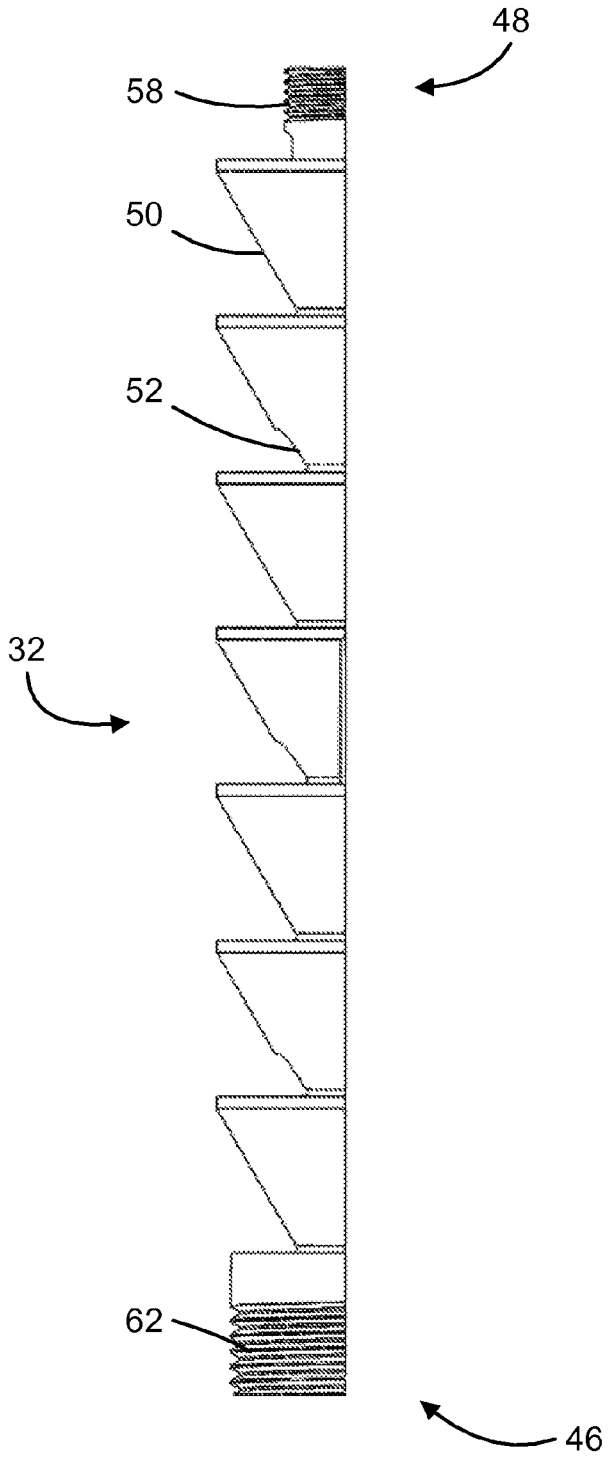
FIG. 3 shows a cross sectional view of one of the elongated bodies containing baffle sections within the noise suppressor of FIG. 1.
Figure 4:
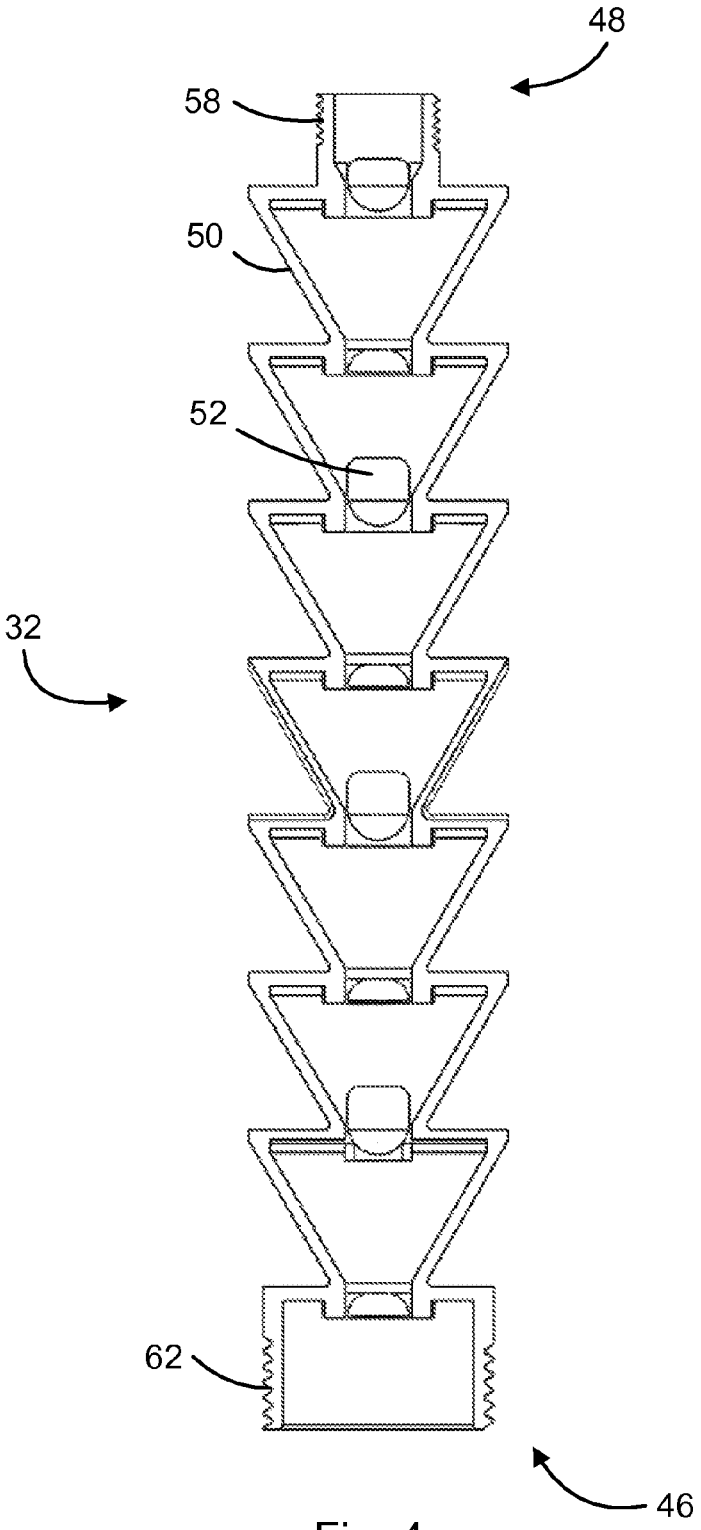
FIG. 4 shows another cross sectional view of one of the elongated bodies containing baffle sections within the noise suppressor of FIG. 1.

FIG. 2 is an exploded side view of suppressor 10 as shown in FIG. 1. As shown, suppressor 10 comprises elongated bodies 30 and 32. Elongated body 30 includes proximal end 34, distal end 36, and multiple baffle sections such as representative baffle section 38. Certain baffles have an aperture such as representative aperture 40 in baffle section 38. Elongated body 30 also includes alignment tabs 42 and 44. Similarly, elongated body 32 includes proximal end 46 and distal end 48. Representative baffle section 50 and representative aperture 52 are shown in FIG. 2. FIGS. 3 and 4 contain additional views of the features of elongated body 32.

When assembled, elongated body 30 is joined to (or mated with) elongated body 32 using alignment tabs 42 and 44 to form a unitary longitudinal baffle system 54 as shown in FIG. 2. In this particular embodiment, baffle section 38 is matched together with baffle section 50 as are similar opposing baffle sections from each elongated body 30 and 32. In this particular embodiment, baffle sections 38 and 50 each have an outer surface that is narrower at one end than the other end and form a substantially conical baffle when mated with each other. In addition, when assembled each baffle formed by opposing baffle sections has an aperture in its outer surface in this particular embodiment. For example the baffle formed by baffle section 38 and baffle section 50 has aperture 40. Similarly, distal end 36 of elongated body 30 is joined with distal end 48 of elongated body 32 to form a circular distal end of unitary longitudinal baffle system 54. Distal ends 36 and 48 have threaded interfaces 56 and 58, respectively. When assembled, threaded interfaces 56 and 58 are joined with distal end cap 22. Similarly, proximal end 34 is joined with proximal end 46 to form a circular proximal end of the of unitary longitudinal baffle system 54. Proximal ends 34 and 46 have threaded interfaces 60 and 62, respectively. When assembled, threaded interfaces 60 and 62 are joined with proximal end cap 18. Outer tube 24 is held in place over unitary longitudinal baffle system 54 by distal end cap 22 and proximal end cap 18 being joined with unitary longitudinal baffle system 54.

As assembled, unitary longitudinal baffle system 54 within suppressor 10 provides several advantages. For example, unitary longitudinal baffle system 54 can be disassembled by first unthreading end caps 18 and 22 from the unitary longitudinal baffle system 54, removing unitary longitudinal baffle system 54 from outer tube 24, and then separating elongated bodies 30 and 32. Once disassembled, each of the pieces of suppressor 10, including end caps 18 and 22, outer tube 24, and elongated bodies 30 and 32 can be easily cleaned. Reassembly of suppressor 10 can be conducted in reverse order. Specifically, elongated bodies 30 and 32 are joined using alignment tabs 42 and 44 to form unitary longitudinal baffle system 54. Unitary longitudinal baffle system 54 is then placed within outer tube 24 and then connected to proximal end cap 18 by threaded interfaces 60 and 62 and distal end cap 22 by threaded interfaces 56 and 58. The small number of parts to reassemble helps to ensure the reassembly is done correctly and all the baffle sections are correctly aligned. This prevents damage to suppressor 10 during subsequent use and helps to ensure that suppressor 10 continues to perform accurately.

Because of the small internal areas and intricate shapes of elongated bodies 30 and 32, as well as the complexity and number of features of each elongated body, elongated bodies 30 and 32 can be manufactured using processes comprising DMLS and casting. DMLS is a particularly effective method to manufacture elongated bodies 30 and 32. DMLS involves the use of a laser to sinter metal material based on a three dimensional computer-aided design (CAD) model in order to manufacture elongated bodies 30 and 32. Similarly, casting is another effective method to manufacture elongated bodies 30 and 32. In general, casting involves forcing molten metal into molds under high pressure. The casting process allows for the manufacture of elongated bodies 30 and 32, which as shown in FIGS. 2-4 contain a number of small, detailed components. Other components of suppressor 10, including end caps 18 and 22 and outer tube 24, can be made using DMLS and casting methods, but can also be manufactured using conventional machining practices. The components of suppressor 10, including end caps 18 and 22, outer tube 24, and elongated bodies 30 and 32, can be manufactured using a number of materials including aluminum.

While various embodiments of apparatus are described with—or without—certain features for ease of description and to illustrate exemplary aspects of those embodiments, the various components and/or features described herein with respect to a particular embodiment can be substituted, added and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A suppressor for a firearm comprising:

an outer tube comprising a proximal end and a distal end, the outer tube having a longitudinal axis;

a proximal end cap defining a bore centered on the longitudinal axis and comprising:

a proximal end adapted to be coupled to a firearm; and a first interface that is threaded and located at a distal end of the proximal end cap;

a distal end cap defining a bore centered on the longitudinal axis and comprising a second interface that is threaded and located at the proximal end of the distal end cap;

a first elongated body comprising:

a proximal end comprising a first semi-circular body having an exterior surface with threads covering at least a portion thereof;

a distal end comprising a second semi-circular body comprising an exterior surface with threads covering at least a portion thereof;

a first baffle section comprising:

a proximal end defining a semi-circular bore aligned with the longitudinal axis;

a distal end defining a semi-circular bore aligned with the longitudinal axis;

an outer surface comprising an aperture, wherein the outer surface of the first baffle section is narrower at the proximal end of the first baffle section than at the distal end of the first baffle section; and an alignment tab;

a second elongated body comprising:

a proximal end comprising a third semi-circular body having an exterior surface with threads covering at least a portion thereof;

a distal end comprising a fourth semi-circular body having an exterior surface with threads covering at least a portion thereof;

a second baffle section comprising:

a proximal end defining a semi-circular bore aligned with the longitudinal axis;

a distal end defining a semi-circular bore aligned with the longitudinal axis; and an outer surface wherein the outer surface of the second baffle section is narrower at the proximal end of the second baffle section than at the distal end of the second baffle section;

wherein the first elongated body and second elongated body are joined utilizing the alignment tab to form a unitary longitudinal baffle system, wherein:

the first baffle section and second baffle section form a first substantially conical baffle;

the first and third semi-circular bodies form a first circular body with threads covering at least a portion of the outer surface of the first circular body that attaches to the first interface of the proximal end cap and secures the first elongated body to the second elongated body;

the second and fourth semi-circular bodies form a second circular body with threads covering at least a portion of the outer surface of the second circular body that attaches to the second interface of the distal end cap and secures the first elongated body to the second elongated body;

wherein the unitary longitudinal baffle system is disposed within and directly contacts the outer tube.

2. The suppressor of claim 1, wherein the proximal end cap, distal end cap, outer tube, first elongated body, and second elongated body comprise a material comprising aluminum.

3. A suppressor for a firearm comprising:

an outer tube comprising a longitudinal axis;

a proximal end adapted to be coupled to a firearm with a bore aligned with the longitudinal axis;

a distal end opposite the proximal end with a bore aligned with the longitudinal axis;

a first elongated body comprising a first baffle section;

a second elongated body comprising a second baffle section;

wherein the first elongated body and second elongated body are removably joined to form a unitary longitudinal baffle system, such that the first baffle section and second baffle section mate together to form a baffle and comprise a bore aligned with the longitudinal axis when the unitary longitudinal baffle system is disposed within the outer tube;

wherein the first elongated body and second elongate body form a first threaded interface and a second threaded interface which help secure the first elongated body to the second elongated body; and wherein the unitary longitudinal baffle system is disposed within and directly contacts the outer tube.

4. The suppressor of claim 3, wherein the suppressor further comprises:

the outer tube comprising a proximal end and a distal end;

a proximal end cap located at the proximal end of the suppressor wherein the proximal end cap comprises:

a proximal end adapted to be coupled to a firearm;

a third threaded interface that is threaded and located at the distal end of the proximal end cap; and a bore aligned with the longitudinal axis;

a distal end cap located at the distal end of the suppressor wherein the distal end cap comprises:

a fourth threaded interface that is threaded and located at the proximal end of the distal end cap; and a bore aligned with the longitudinal axis.

5. The suppressor of claim 4, wherein the baffle is a substantially conical baffle.

6. The suppressor of claim 5, wherein the first baffle section further comprises an alignment tab.

7. The suppressor of claim 6, wherein the first elongated body further comprises a proximal end comprising a first semi-circular body comprising an exterior surface with threads covering at least a portion thereof and a distal end comprising a second semi-circular body comprising an exterior surface with threads covering at least a portion thereof.

8. The suppressor of claim 7, wherein the second elongated body further comprises a proximal end comprising a third semi-circular body comprising an exterior surface with threads covering at least a portion thereof and a distal end comprising a fourth semi-circular body comprising an exterior surface with threads covering at least a portion thereof.

9. The suppressor of claim 8, wherein the first and third semi-circular bodies form a first circular body with threads covering at least a portion of the outer surface of the first circular body that form the first threaded interface that attaches to the third threaded interface of the proximal end cap; and the second and fourth semi-circular bodies form a second circular body with threads covering at least a portion of the outer surface of the second circular body that form the second threaded interface attaches to the forth threaded interface of the distal end cap.

10. The suppressor of claim 9, wherein the first elongated body and second elongated body are manufactured using direct metal laser sintering.

11. The suppressor of claim 9, wherein the first elongated body and second elongated body are manufactured using casting.

* * * * *